US005659147A

United States Patent [19]

Rouse et al.

[11] Patent Number: 5,659,147

[45] **Date of Patent: *Aug. 19, 1997**

[54] METHOD OF ASSEMBLY OF COMPACTED FIBERS AND EXPLOSIVE CHARGE FOR EFFECTIVE DISSEMINATION

[75] Inventors: William G. Rouse, Aberdeen; John P. Fiala; Lisa A. Caudill, both of Forest Hill, all of Md.; Connie S. Kilgore, New Park, Pa.

[73] Assignee: The United States of America as represented by the Secretary of the Army, Washington, D.C.

[ * ] Notice: The term of this patent shall not extend beyond the expiration date of Pat. No. 5,148,173.

[21] Appl. No.: 377,234

[22] Filed: Jan. 26, 1995

Related U.S. Application Data

[63] Continuation of Ser. No. 6,587, Jan. 21, 1993, abandoned.

[51] Int. Cl.[6] ..... F42B 3/00; F42B 4/14

[52] U.S. Cl. ..... 86/20.14; 102/351; 102/357; 102/482; 342/4; 264/3.1

[58] Field of Search ..... 342/1, 4; 102/351, 102/357, 482; 86/20.14; 264/3.1

[56] References Cited

U.S. PATENT DOCUMENTS 5,061,533 10/1991 Gomi et al. ..... 428/113 X
5,437,905 8/1995 Park ..... 428/113 X

*Primary Examiner*—Peter A. Nelson
*Attorney, Agent, or Firm*—Edward Goldberg; Michael C. Sachs; Edward L. Stolarun

[57] ABSTRACT

A millimeter wave screening cloud-forming product is made by forming compacted hollow disks of carbon fiber cut to a desired length. The handleable disks are stacked inside a grenade body forming a hollow cylindrical shape. A high explosive mass is inserted into the resulting compacted hollow cylinder, enabling bursting of the compacted mass to release the individual carbon fibers.

8 Claims, No Drawings

METHOD OF ASSEMBLY OF COMPACTED FIBERS AND EXPLOSIVE CHARGE FOR EFFECTIVE DISSEMINATION

RELATED APPLICATIONS

This application is a continuation application of Ser. No. 08/006,587, filed Jan. 21, 1993, and now abandoned.

GOVERNMENTAL INTEREST

The invention described herein may be manufactured, used and licensed by or for the Government for governmental purposes without payment to us of any royalties thereon.

FIELD OF USE

This invention relates to a method of assembly of compacted fibers, particularly very fine carbon fibers which are normally very light and fluffy, together with an explosive charge for aerosolizing the resulting compacted mass of material.

BACKGROUND OF THE INVENTION

Efforts to develop a millimeter wave screening cloud that will protect military equipment from radar detection have been underway for a number of years. Various military vehicles are conventionally equipped with smoke grenades and suitable launchers, such as launching tubes or barrels, singly or in clusters, whereby the grenades are launched to provide a visual screen relative to the vehicle.

SUMMARY OF THE INVENTION

It is an object of the invention to form a compact mass of fine strands of carbon composition for use in a volume-limited grenade to enable dissemination of the particles as a millimeter wave screening cloud, in a manner compatible with current vehicle-mounted smoke grenade launcher systems. Screening effectiveness is optimized by providing a high explosive central burster within the resultant densely compacted specially-sized carbon composition for a volume-limited device such as a millimeter wave smoke screening grenade.

Still other objects and attendant advantages will become apparent to those skilled in the art, from a reading of the following detailed description of an illustrative mode of practice of the invention.

PREFERRED EMBODIMENT

Very fine strands of carbon composition, particularly Hercules AU4 are suitably compacted by aligning and compressing lengths of the fiber into a long thick walled hollow cylindrical shape having interior and exterior retaining tubes. The retaining tubes are concentrically arranged and act to radially compress the fibers therebetween, and are frangible under detonation conditions to enable the dispersion of the fibers. The hollow cylindrical bar is then cut to the desired fiber length resulting in disks of high density, aligned fiber material.

The hollow disks are then stacked inside a frangible plastic body forming a hollow cylinder with a carbon fiber density of about 1.0 gm/cubic cm.

In sequence, a cylindrical mass of high explosive is inserted within a guide tube, and a cover is suitably secured in the end of the body over the entire assembly of the final compacted mass of carbon fibers and the high explosive cylindrical mass. The forming of high density disks is employed to reduce the volume occupied by the carbon strands but the carbon strands are, nevertheless, capable of being aerosolized by the high explosive mass without destroying the preestablished length.

This entire assembly may suitably form a projectile or grenade having a closed base with a tubular body and a cover, which may be suitably projected into the atmosphere and caused to burst by detonating the high explosive, as by suitable ignition and detonation means.

A millimeter wave screening cloud will thus be formed in the atmosphere at the desired location.

In carrying out the foregoing method, it is an important and integral part thereof to employ suitable high aspect ratio fibrous material. To this end, polyacrylonitrile based carbon fibers have been found compatible with the necessary high explosive blast. Particularly, never sized, and epoxy sized and desized, polyacrylonitrile based carbon fibers have been successfully employed with adequate aerosolizing and cloud retention time, such being generally cylindrical in shape and being generally of a size of the order of approximately 3–7 micron diameter and 3–15 millimeter length. Fibers similar to those which are employed as reinforcement in thermoplastic molding compounds have been found to be highly suitable for practice of this invention.

It has been found that a hollow cylindrical or tubular shape is a desirable configuration to enable both adequate bursting of the compact particle mass to aerosol the fibers in the atmosphere, and also to enable its use in a conventionally launchable cylindrical grenade form.

The term high explosive is generally accepted as being a composition whose consumption rate is 20,000 feet per second or greater.

A ratio of the weight of the compacted mass of material relative to the high explosive charge mass may be employed within the general range of approximately 60:1 to 30:1, with an optimum ratio being approximately 50:1, particularly for carbon fiber. This yields maximum millimeter wave screening attenuation over an adequate area to screen the source vehicle and the surrounding personnel or vehicles from enemy vehicles and enemy personnel, consistent with grenade volume and shape constraints imposed by launching from a launch tube of desired conventional relatively small size.

A particular advantage of the specially packaged carbon material, for the compacted fibers, is the ability of these fibers to provide a highly effective millimeter wave screening cloud of adequately long retention, while not disintegrating or igniting as a result of the explosive bursting of the compact mass by the high explosive.

While the invention has been illustrated and described with respect to a single illustrative embodiment, it will be appreciated that various modifications and improvements may be made without departing from the scope and spirit of the invention. Accordingly, the invention is not to be limited by the particular illustrative embodiment, but only by the scope of the appended claims.

What is claimed is:

1. The method of forming a product which may be explosively burst apart to form a millimeter wave screening cloud, comprising:

forming a hollow bar of aligned fibers of carbon composition;

cutting said hollow bar into disks of a predetermined length to thereby form a compact mass of aligned fibers of desired length; and stacking said disks inside a frangible body to form a hollow cylinder having carbon fibers compressed to a density of about 1.0 grams/cubic centimeter within said body.

2. The method according to claim 1 wherein said fibers are longitudinally aligned.

3. The method according to claim 1 wherein said fibers are radially compressed between two concentric frangible tubes.

4. The method according to claim 1 wherein said disks are stacked in a conventional cylindrical grenade body.

5. The method according to claim 1 including stacking said hollow disks to form a cylindrical opening suitable for inserting a bursting charge.

6. The method according to claim 5 including inserting an elongate high explosive bursting charge within said cylindrical opening along the length of said compact mass of fibers.

7. The method according to claim 1 wherein the ratio of the weight of the compacted mass of fibers relative to the high explosive charge is in the general range of 60:1 to 30:1.

8. The method according to claim 1 including aligning said dissemination disks to increase the survivability of the fibers upon fibers.

* * * * *